US006349646B1

(12) United States Patent
Hasegawa et al.

(10) Patent No.: US 6,349,646 B1
(45) Date of Patent: Feb. 26, 2002

(54) BLANKET-MOUNTING MECHANISM OF PRINTING PRESS

(75) Inventors: Toshio Hasegawa, Kawasaki; Kenji Kusunoki, Atsugi; Yukitoshi Takahashi, Kawasaki, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/504,382

(22) Filed: Feb. 15, 2000

(30) Foreign Application Priority Data

Sep. 22, 1999 (JP) ..... 11-268253

(51) Int. Cl.[7] ..... B41F 27/12
(52) U.S. Cl. ..... 101/415.1; 101/378
(58) Field of Search ..... 101/378, 415.1

(56) References Cited

U.S. PATENT DOCUMENTS 3,016,010 A * 1/1962 Luehrs ..... 101/415.1
3,332,346 A * 7/1967 Luehrs ..... 101/415.1
5,131,327 A * 7/1992 Nagasono et al. ..... 101/415.1

FOREIGN PATENT DOCUMENTS

JP 61-133332 8/1986
JP 7-285214 10/1995

* cited by examiner

*Primary Examiner*—Leslie J. Evanisko
(74) *Attorney, Agent, or Firm*—Armstrong, Westerman & Hattori, LLP

(57) ABSTRACT

A blanket-mounting mechanism includes a dragging shaft, a rotating device, a correction device, and a deflection suppression device. A dragging-shaft accommodation bore extends axially through a blanket cylinder. A blanket insertion groove extends axially on the outer circumferential surface of the blanket cylinder and extends radially to the dragging-shaft accommodation bore. The dragging shaft has a blanket-end reception groove formed on the outer circumferential surface and adapted to receive one end of a blanket. The dragging shaft is inserted into the dragging-shaft accommodation bore with an appropriate gap maintained therebetween and is supported rotatably. The rotating device is disposed at the side of one end face of the blanket cylinder and is connected to the dragging shaft. The correction device is disposed at the side of the other end face of the blanket cylinder and is able to grip/release the dragging shaft so as to adjust the angular position of the dragging shaft. The deflection suppression device supports the dragging shaft accommodated within the dragging-shaft accommodation bore while permitting the dragging shaft to rotate.

6 Claims, 6 Drawing Sheets

BLANKET-MOUNTING MECHANISM OF PRINTING PRESS

BACKGROUND OF THE INVENTION

1. Field of the Invention

The present invention relates to a blanket-mounting mechanism for mounting a blanket onto a blanket cylinder of an offset press, as well as to a blanket.

2. Description of the Related Art

Conventionally, by means of a blanket-mounting mechanism, a blanket is mounted onto a blanket cylinder in the following manner. One end of the blanket is appropriately attached to the blanket cylinder. The blanket is wound onto the outer circumferential surface of the blanket cylinder. The other end of the blanket is inserted into a groove formed in a single dragging shaft disposed within the blanket cylinder. The dragging shaft is rotated so as to windingly drag the blanket into the blanket cylinder, thereby mounting the blanket onto the blanket cylinder. Such a blanket-mounting mechanism and a blanket are disclosed in, for example, Japanese Utility Model Application Laid-Open (kokai) No. 61-133332 and Japanese Patent Application Laid-Open (kokai) No. 7-285214.

The blanket-mounting mechanism disclosed in Japanese Utility Model Application Laid-Open No. 61-133332 includes a hollow dragging shaft, a torsion bar, and an adjustment mechanism. The dragging shaft is disposed in a groove which extends axially in the blanket cylinder and opens at the circumferential surface of the blanket cylinder. The opposite ends of the dragging shaft are rotatably supported by the opposite end portions of the blanket cylinder. The torsion bar is coaxially disposed within a hollow portion of the dragging shaft. One end of the torsion bar is connected to one end of the dragging shaft. The other end of the torsion bar projects from the other end of the dragging shaft. Via the adjustment mechanism, the projecting end of the torsion bar is attached to the corresponding end portion of the blanket cylinder, which end portion rotatably supports the other end of the dragging shaft. The adjustment mechanism is adapted to adjust the angular displacement of the torsion bar.

One end of the dragging shaft projects from the corresponding end portion of the blanket cylinder, which end portion rotatably supports the one end of the dragging shaft. A worm wheel is attached to the projecting end of the dragging shaft. A removable handled worm can be engaged with the worm wheel.

The blanket is mounted onto the blanket cylinder in the following manner. One end of the blanket is fixedly fitted into a groove which is axially formed in the circumferential surface of the blanket cylinder. The blanket cylinder is rotated so as to wind the blanket onto the outer circumferential surface of the blanket cylinder. The handled worm is set in a predetermined position so as to be engaged with the worm wheel and is rotated manually to thereby rotate the worm wheel. As the worm wheel rotates, the dragging shaft rotates to thereby twist the torsion bar, since one end of the torsion bar is connected to the dragging shaft. Thus, a restoration force is accumulated. When a blanket attachment portion of the dragging shaft reaches an appropriate position through rotation of the dragging shaft, the other end of the blanket is attached to the blanket attachment portion.

Next, the handled worm is rotated in the reverse direction so that the dragging shaft windingly drags in the other end of the blanket. When the tension exerted by the blanket and the restoration force accumulated in the torsion bar balance with each other, the worm wheel stops rotating. When the handled worm is rotated further in the reverse direction, the handled worm is disengaged from the halted worm wheel.

Thus, mounting of the blanket onto the blanket cylinder is completed.

In the blanket-mounting mechanism disclosed in Japanese Patent Application Laid-Open No. 7-285214, the opposite ends of a dragging shaft project from the corresponding end faces of a blanket cylinder. Rotating means composed of a worm and a worm wheel is disposed at each end of the dragging shaft.

Further, Japanese Patent Application Laid-Open No. 7-285214 states that some blanket-mounting mechanisms employ a structure in which rotating means comprising a lever and a latch mechanism is provided. The publication also discloses a structure such that a blanket to be attached to a blanket cylinder is provided with a thin band sheet attached to opposite end portions of the blanket cylinder to be located on a single side thereof.

The above-mentioned conventional techniques involve the following problems.

In the blanket-mounting mechanism disclosed in Utility Model Application Laid-Open (kokai) No. 133332/1986, a torque exerted by the torsion bar is transmitted to the dragging shaft through one end thereof to thereby rotate the dragging shaft. The blanket is windingly dragged into the blanket cylinder and is thus wound onto the blanket.

However, in the case of a long dragging shaft, the other end of the dragging shaft to which a torque exerted by the torsion bar is not directly transmitted exhibits a smaller angular displacement than does the opposite end, because of the action of a frictional force. As a result, the dragging shaft is twisted.

Since a central portion of the dragging shaft is not supported, the dragging shaft deflects at the central portion due to the tension exerted by the blanket.

Thus, the blanket mounted on the blanket cylinder is not subjected to uniform tension. The blanket is mounted on the blanket cylinder while being pulled at a constant tension and remaining in close contact with the surface of the blanket cylinder. Since the blanket is stretched, the thickness thereof varies slightly.

Moreover, if a nonuniform tension is exerted on the blanket, the thickness of the blanket becomes nonuniform, causing nonuniform contact pressure between the blanket and a printing cylinder or between the blanket and printing paper. As a result, a certain portion may not be printed under an appropriate pressure, with a resultant impairment in printing quality.

In the blanket-mounting mechanism disclosed in Japanese Patent Application Laid-Open No. 7-285214, when the blanket is to be windingly dragged into the blanket cylinder, the opposite ends of the dragging shaft must be alternatingly rotated. Dragging work is both labor consuming and time consuming.

In the case of the rotating means composed of a lever and a latch mechanism, one end of the dragging shaft is rotated so as to windingly drag the blanket into the blanket cylinder, and then the other end of the dragging shaft is rotated so as to compensate a torsion of the dragging shaft. Since the angular displacement of the dragging shaft, or the degree of drag of the blanket, and the reverse angular displacement of the dragging shaft for compensation of a torsion of the dragging shaft are in units directly related to the tooth pitch of the latch mechanism, the tension exerted by the mounted blanket cannot be adjusted optimally for the thickness and physical characteristics of the blanket.

As a result, the tension exerted by the blanket mounted on the blanket cylinder may be slightly weak or strong with respect to an optimum level, resulting in a failure to obtain desired printing quality. Also, the life of the blanket is shortened.

Further, since the deflection of the dragging shaft cannot be prevented, the blanket cannot be mounted onto the blanket cylinder while being subjected to uniform tension. Therefore, as in the case of the blanket-mounting mechanism disclosed in Utility Model Application Laid-Open No. 61-133332, good printing quality is not provided.

The blanket disclosed in Japanese Patent Application Laid-Open No. 7-285214 has a band sheet attached to opposite end portions located on a single side. The band sheet serves as a reinforcing member and is long and narrow. When a worker handles the band sheet, an external force may be exerted thereon, potentially causing a slight warpage or torsion thereof. Particularly, in the case of a deformation of the band sheet to be attached to an end portion of the blanket which is to be inserted into a groove formed in the dragging shaft, insertion of the end portion into the groove may become difficult or impossible.

SUMMARY OF THE INVENTION

An object of the present invention is to provide a blanket-mounting mechanism featuring a simple mechanism and easy operation, allowing a blanket to be easily mounted onto a blanket cylinder, capable of adequately adjusting the tension exerted by the mounted blanket so as to optimize the state of drag according to the thickness and physical properties of the blanket, and capable of adequately compensating a torsion of a dragging shaft to thereby enable of mounting of the blanket with uniform tension.

Another object of the present invention is to provide a blanket-mounting mechanism capable of minimizing the deflection of the dragging shaft due to the tension exerted by the blanket to thereby enable of mounting of the blanket with more uniform tension.

Still another object of the present invention is to provide a blanket in which a reinforcing member attached to one end thereof to be inserted into a groove formed in the dragging shaft is not susceptible to deformation.

To achieve the above objects, the present invention provides a blanket-mounting mechanism comprising a blanket cylinder having a dragging-shaft accommodation bore and a blanket insertion groove, a dragging shaft, rotating means, and correction means. The dragging-shaft accommodation bore extends axially through the blanket cylinder. The blanket insertion groove extends axially on the outer circumferential surface of the blanket cylinder and extends radially to the dragging-shaft accommodation bore. The dragging shaft has a blanket-end reception groove formed on the outer circumferential surface. The blanket-end reception groove has an appropriate width and depth so as to receive one end of a blanket to be mounted on the blanket cylinder. The dragging shaft is inserted into the dragging-shaft accommodation bore with an appropriate gap maintained therebetween. The opposite end portions of the dragging shaft are rotatably supported by and project from the corresponding end faces of the blanket cylinder. The rotating means is disposed at the side of one end face of the blanket cylinder and is connected to the corresponding end portion of the dragging shaft so as to rotate the dragging shaft. The correction means is disposed at the side of the other end face of the blanket cylinder and comprises an angular-displacement member and adjusting means. The angular-displacement member is attached to the corresponding end portion of the dragging shaft in such a manner as to be able to grip/release the end portion of the dragging shaft. The adjusting means angularly displaces and positions the angular-displacement member about the dragging shaft.

Preferably, one of two side walls that define the blanket insertion groove is substantially in parallel to a plane tangent to the dragging-shaft accommodation bore, and the other side wall extends in a radial direction of the blanket cylinder and toward the center of the dragging-shaft accommodation bore. Thus, the blanket insertion groove assumes a wedged cross section that tapers down toward the outer circumferential surface of the blanket cylinder.

Preferably, the blanket-mounting mechanism further comprises deflection suppression means disposed in the blanket cylinder in at least one axial position. The deflection suppression means faces the circumferential surface of the dragging shaft accommodated within the dragging-shaft accommodation bore with a small gap formed therebetween. The deflection suppression means rotatably supports the dragging shaft while restricting deflection of the dragging shaft to an amount corresponding to the small gap.

Preferably, the deflection suppression means is a block fitted in a depression formed in the blanket cylinder. The block has a cylindrically curved inner surface which is concentric with the dragging-shaft accommodation bore, which has a diameter smaller than that of the dragging-shaft accommodation bore, and which faces the circumferential surface of the dragging shaft with a small gap formed therebetween so that the block can rotatably support the dragging shaft while restricting deflection of the dragging shaft to an amount corresponding to the small gap.

The present invention further provides a blanket to be mounted on a blanket cylinder. The blanket comprises a blanket body and two band sheets serving as reinforcing members and attached to the corresponding parallel, opposite end portions of the blanket body across the width of the end portions. One of the band sheets is attached to one end portion of the blanket body and on the side of the blanket body which comes into contact with the blanket cylinder when the blanket is mounted on the blanket cylinder. The other band sheet is longitudinally folded in two and is attached to the other end portion of the blanket body such that the other end portion is sandwiched therebetween.

The above-mentioned blanket is mounted on the blanket cylinder in the following manner. The dragging shaft is released-beforehand from the angular-displacement member of the correction means. The angular-displacement member is rotated about the dragging shaft to an appropriate angular position.

The dragging shaft must be in such an angular position that the blanket-end insertion groove formed therein is aligned with the blanket insertion groove formed in the blanket cylinder. If the dragging shaft is not in such a position, the dragging shaft is rotated thereto by uge of the rotating means.

One end portion of the blanket is inserted into the blanket insertion groove such that the band sheet attached to the blanket end portion faces the side wall of the blanket insertion groove.

Upon starting of a printing press, the blanket cylinder is rotated at low speed. The blanket begins to be wound onto the circumferential surface of the blanket cylinder. Upon completion of about one rotation, the blanket cylinder is caused to stop rotating. The blanket is wound on the blanket cylinder.

The other end portion of the blanket is inserted into the blanket insertion groove along the side wall of the groove until the band sheet of the other end portion of the blanket is fitted into the blanket-end reception groove formed in the dragging shaft.

The dragging shaft is rotated by use of the rotating means so as to windingly drag in the blanket. As the tension exerted by the blanket increases, the end portion of the blanket located within the blanket insertion groove is pressed further toward a side wall of the blanket insertion groove by a portion of the blanket which is being dragged in, thereby being fixed within the blanket insertion groove. The end portion is only slightly susceptible to deformation by virtue of the band sheet attached thereto as a reinforcing member.

As the dragging shaft is rotated further to further drag in the blanket, the tension exerted by the blanket increases further, causing a deflection of an axially central portion of the dragging shaft. However, the deflected portion of the dragging shaft comes into contact with the inner curved surface of the block serving as the deflection suppression means and disposed in the direction of deflection of the dragging shaft, thereby preventing a further deflection of the dragging shaft and thus maintaining constant the tension exerted by the blanket mounted on the blanket cylinder.

As mentioned above, the blanket is wound onto the blanket cylinder by use of the rotating means. The angular displacement of one end portion of the dragging shaft which is directly rotated by the rotating means is greater than that of the other end portion of the dragging shaft which is rotated as a follower, causing a torsion of the dragging shaft. As a result, the tension exerted by the blanket becomes nonuniform.

In order to compensate the nonuniform tension exerted by the blanket, the angular-displacement member of the correction means is caused to grip the end portion of the dragging shaft. The angular-displacement member is rotated about the axis of the dragging shaft so as to compensate an insufficient angular displacement of the gripped end portion of the dragging shaft with respect to the angular displacement of the directly rotated end portion of the dragging shaft. The gripped end portion of the dragging shaft is rotated accordingly.

Thus, the torsion of the dragging shaft is eliminated, thereby compensating the difference in the tension exerted by the blanket as observed between the opposite end portions of the dragging shaft. The blanket is mounted on the blanket cylinder while being subjected to uniform tension.

The blanket-mounting mechanism according to the present invention facilitates the operation of mounting the blanket onto the blanket cylinder, prevents deflection of the dragging shaft, which would otherwise occur during the mounting operation, and corrects and eliminates torsion of the dragging shaft.

Accordingly, the blanket can be attached to the blanket cylinder with uniform tension, so that high printing quality is guaranteed.

Further, at one end of the blanket which is inserted into the blanket-end reception groove of the dragging shaft via the blanket insertion groove of the blanket cylinder, one band sheet is attached to a surface of the blanket body which comes into contact with the blanket cylinder when the blanket is mounted on the blanket cylinder. Another band sheet is longitudinally folded in two and is attached to the other end portion of the blanket body such that the other end portion is sandwiched therebetween. The thus-attached band sheets reinforce the corresponding end portions of the blanket to thereby prevent warpage or torsion which the blanket end portions would otherwise undergo during mounting of the blanket onto the blanket cylinder.

Accordingly, during mounting of the blanket onto the blanket cylinder, a worker can easily and reliably insert one end portion of the blanket into the blanket-insertion groove formed in the blanket cylinder and the other end portion of the blanket into the blanket-end reception groove formed in the dragging shaft. Thus, the burden imposed on the worker is reduced, and work efficiency is improved.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENT

An embodiment of the present invention will next be described in detail with reference to the drawings.

Figure 1:
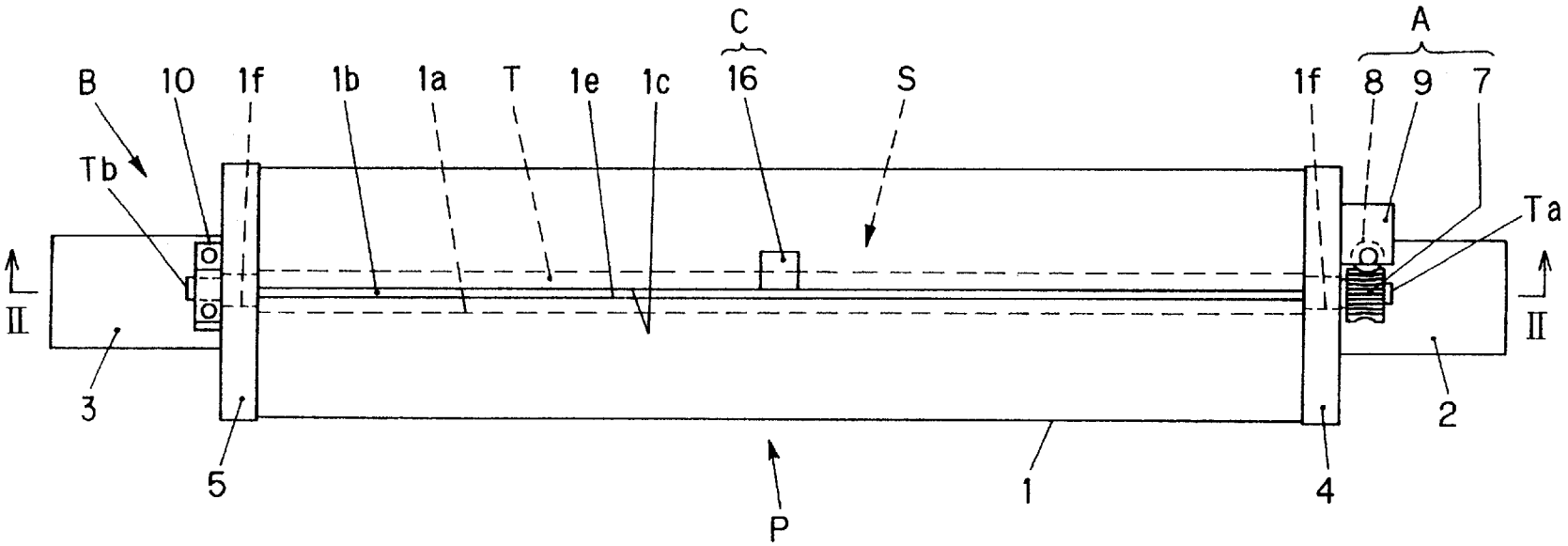
FIG. 1 is a plan view showing a blanket-mounting mechanism of a blanket cylinder according to an embodiment of the present invention.
Figure 2:
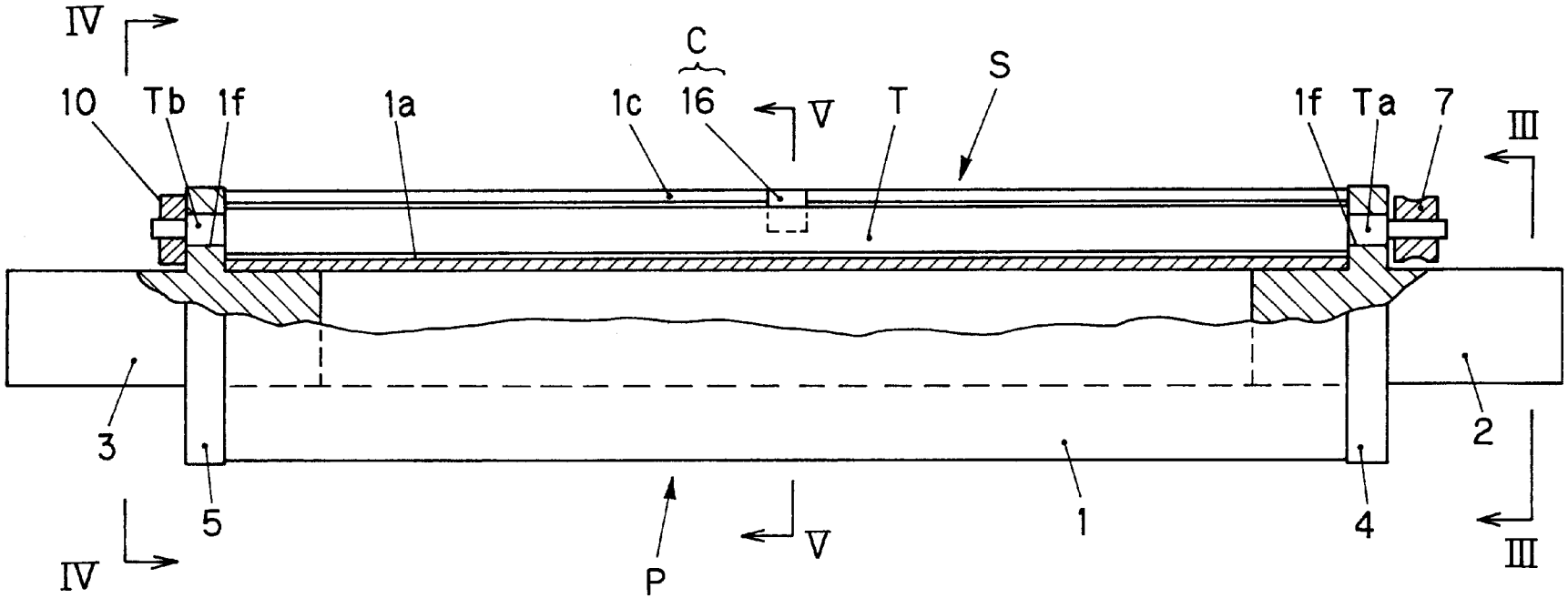
FIG. 2 is a partially sectional view taken along line II—II of FIG. 1.
Figure 8:
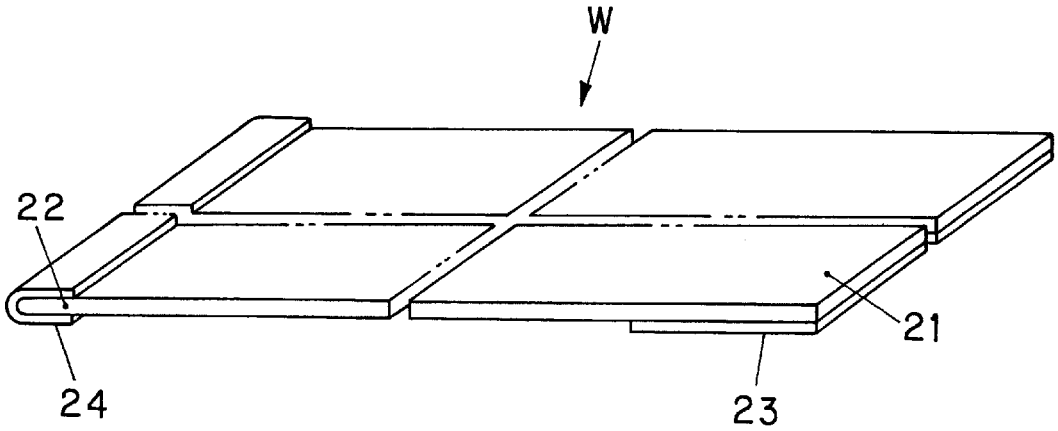
FIG. 8 is a perspective view showing a blanket according to an embodiment of the present invention.

Referring to FIGS. 1 and 2, a blanket W as shown in FIG. 8 is mounted onto a blanket cylinder P of a printing unit of a printing press by means of a blanket-mounting mechanism S.

Referring to FIGS. 1 and 2, a blanket W as shown in FIG. 8 is mounted onto a blanket cylinder P of a printing unit of a printing press by means of a blanket-mounting mechanism S. As shown in FIG. 8, band sheets 23 and 24 serving as reinforcing members are attached to parallel, opposite end portions 21 and 22, respectively, across the width of the blanket W.

As shown in FIGS. 1 and 2, the blanket cylinder P includes a thick-walled hollow cylinder body 1 and shaft members 2 and 3 attached to the corresponding opposite end portions of the cylinder body 1. A flange-shaped bearer 4 (5) having a diameter slightly larger than that of the cylinder body 1 is formed on an axially central portion of the shaft member 2 (3). One end portion of the shaft member 2 (3) is fixedly fitted into the hollow portion of the cylinder body 1 such that the bearer 4 (5) abuts the end face of the cylinder body 1 while the other end portion of the shaft member 2 (3) projects, thereby forming a journal.

Figure 9:
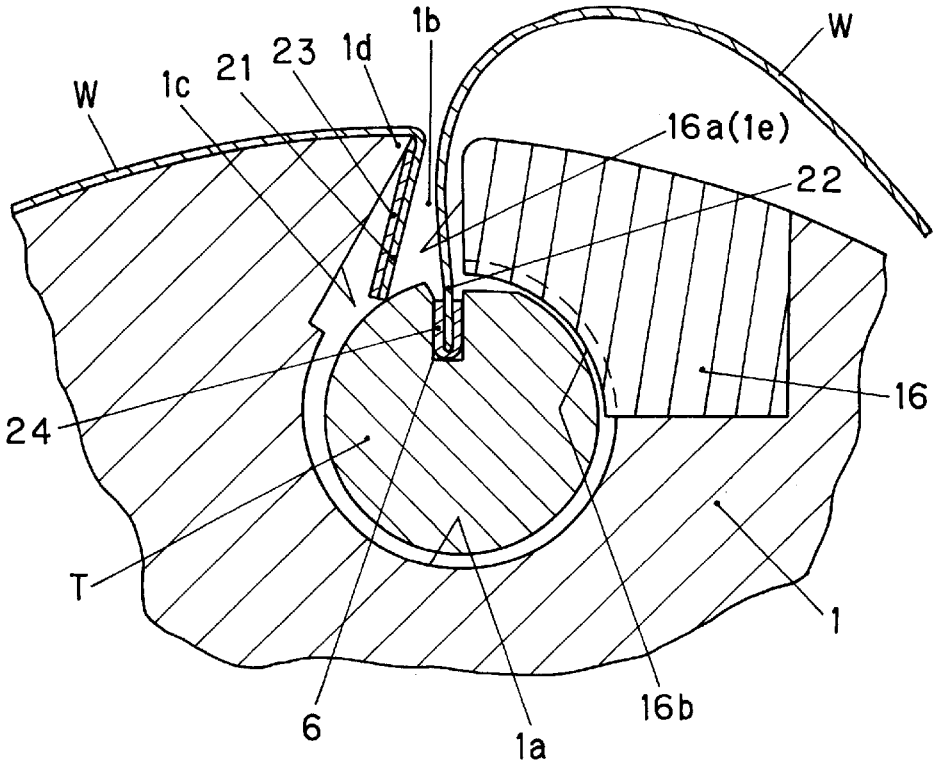
FIG. 9 is an explanatory view illustrating an initial stage of an operation of mounting a blanket onto a blanket cylinder by use of the blanket-mounting mechanism of the embodiment.
Figure 10:
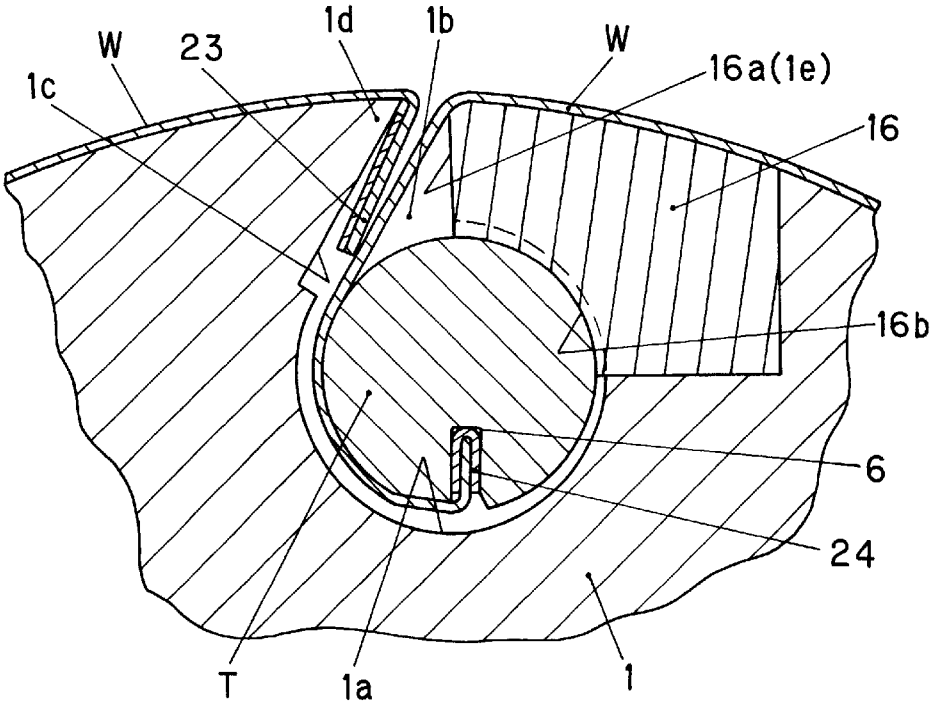
FIG. 10 is an explanatory view illustrating a state after completion of the mounting operation.

A circular dragging-shaft accommodation bore 1*a* extends axially through the cylinder body 1 in order to accommodate a dragging shaft T, which will be described later. A blanket insertion groove 1*b* is formed on the outer circumferential surface of the cylinder body 1 in such a manner as to extend axially and substantially radially to the dragging-shaft accommodation bore 1*a*. As shown in FIGS. 9 and 10, one side wall 1*c* of the blanket insertion groove 1*b* is substantially in parallel to a plane tangent to the dragging-shaft accommodation bore 1*a* and forms an acute edge 1*d* in cooperation with the outer circumferential surface of the cylinder body 1.

The other side wall 1*e* of the blanket insertion groove 1*b* extends in a radial direction of the cylinder body 1 and toward the center of the dragging-shaft accommodation bore 1*a*, so that the blanket insertion groove 1*b* assumes a wedged cross section that tapers down toward the outer circumferential surface of the cylinder body 1. A stepped portion is formed at a connection portion between the side wall 1*c* and the surface of the dragging-shaft accommodation bore 1*a*.

A circular hole 1*f* having a diameter smaller than that of the dragging-shaft accommodation bore 1*a* is formed through the bearers 4 and 5, concentrically with the dragging-shaft insertion bore 1*a*.

The blanket-mounting mechanism S includes the dragging shaft T, rotating means A, correction means B, and deflection suppression means C. The dragging shaft T is accommodated in the cylinder body 1. The rotating means A and the correction means B are disposed on the corresponding side faces of the bearers 4 and 5. The deflection suppression means C is disposed in the cylinder body 1.

The dragging shaft T is a round rod having a diameter which is appropriately smaller than that of the dragging-shaft accommodation bore 1*a*. A small-diameter portions Ta and Tb are formed at the opposite ends of the dragging shaft T. The dragging shaft T is inserted in the dragging-shaft accommodation bore 1*a* while an appropriate gap is formed therebetween. The small-diameter portions Ta and Tb are rotatably fitted into the corresponding circular holes 1*f* formed in the bearers 4 and 5 while an axial movement is restricted. The small-diameter portion Ta (Tb) reduces further in diameter and projects from the bearer 4 (5).

A blanket-end reception groove 6 is axially formed on the outer circumferential surface of the dragging shaft T. The width and depth of the blanket-end reception groove 6 is determined so as to receive one end portion of a blanket to be mounted on the blanket cylinder P.

The rotating means A is disposed on the side face of the bearer 4 and is composed of a worm gear (a worm wheel 7 and a worm 8) for rotating the dragging shaft T within the dragging-shaft accommodation bore 1*a*.

Figure 3:
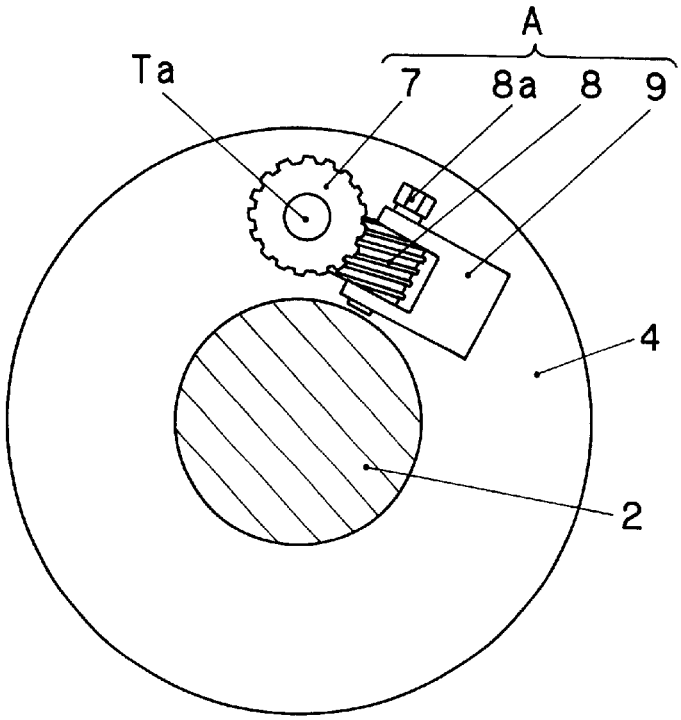
FIG. 3 is a sectional view taken along line III—III of FIG. 2.

As shown in FIGS. 2 and 3, the worm wheel 7 is integrally attached to a protrusion from the small-diameter portion Ta of the dragging shaft T. The worm 8 is rotatably supported by a block 9 attached to the outer side wall of the bearer 4 and is engaged with the worm wheel 7. A shaft end portion 8*a* of the worm 8 projects from the block 9 and assumes such a shape as to engage an unillustrated tool, such as a wrench, so that the worm 8 can be rotated by means of the tool.

The correction means B is attached to the side face of the bearer 5 and is adapted to compensate a torsion of the dragging shaft T.

Figure 4:
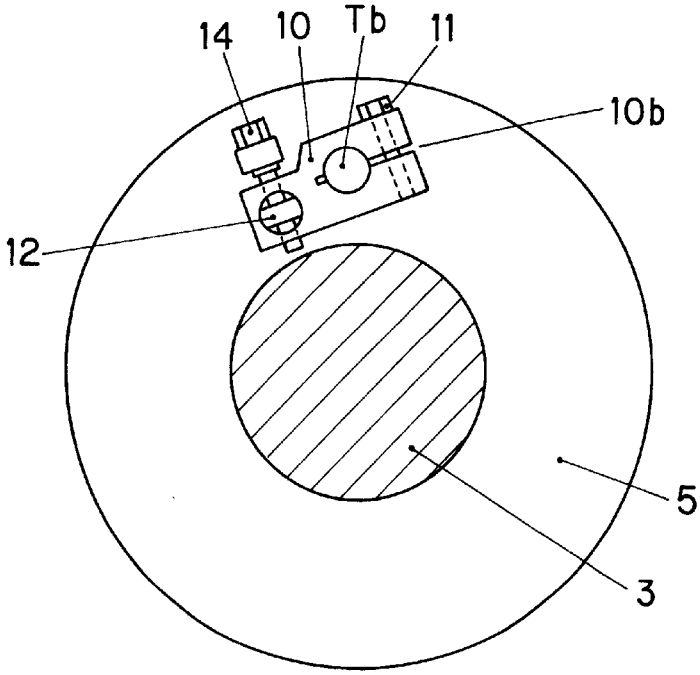
FIG. 4 is a sectional view taken along line IV—IV of FIG. 2.
Figure 5:
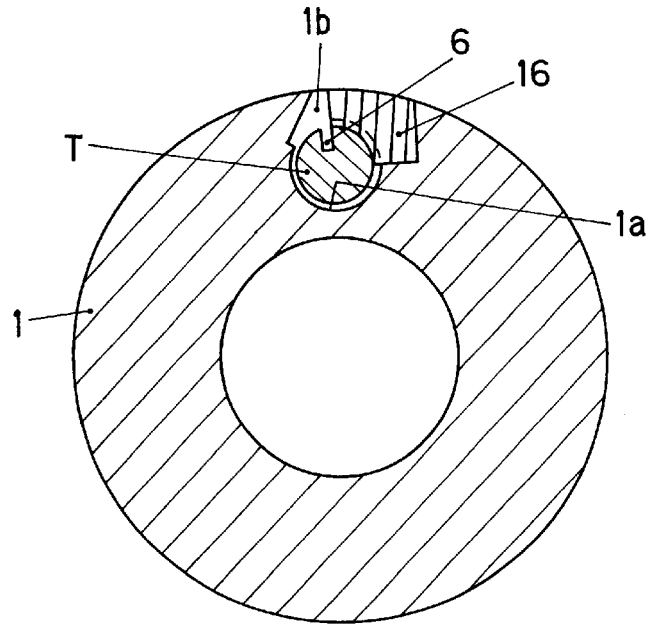
FIG. 5 is a sectional view taken along line V—V of FIG. 2.
Figure 6:
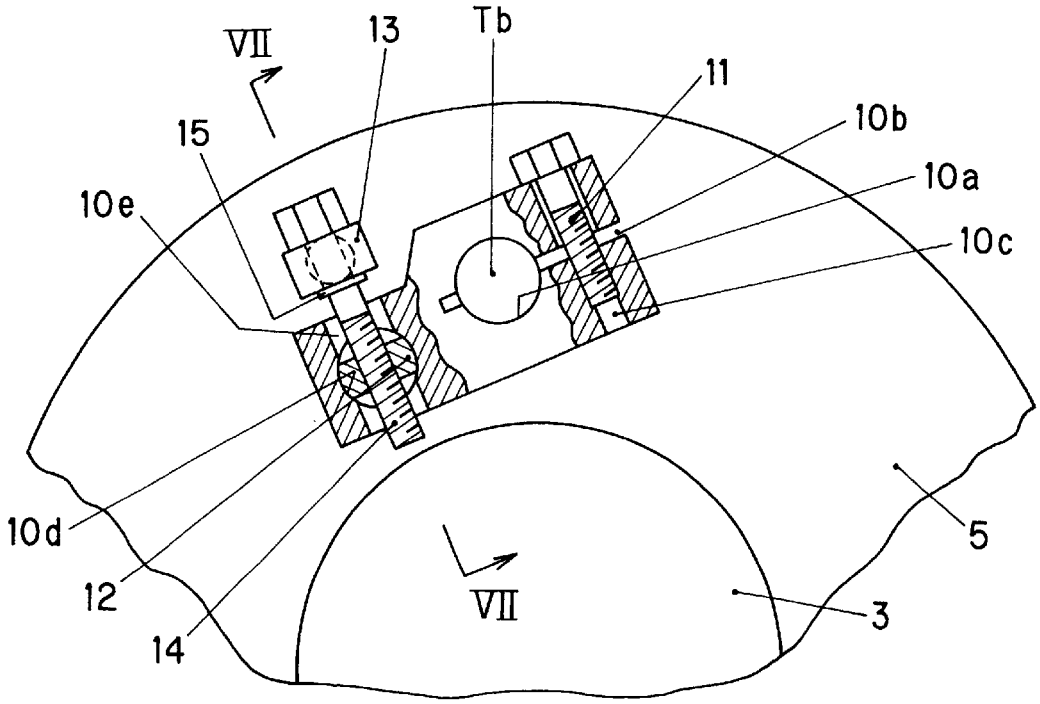
FIG. 6 is a partially sectional, enlarged partial view of FIG. 4.
Figure 7:
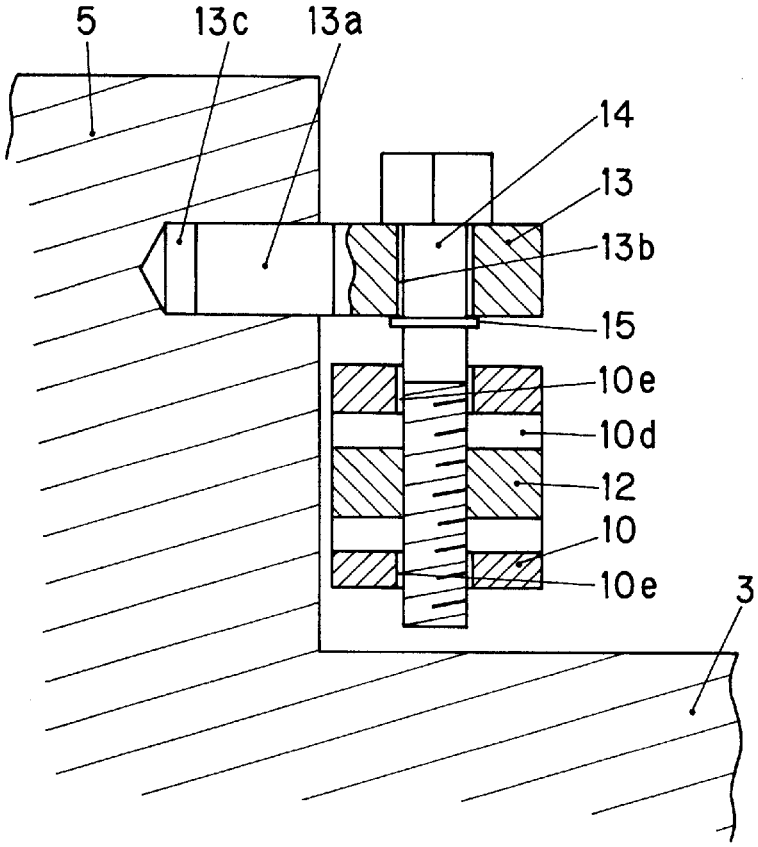
FIG. 7 is a sectional view taken along line VII—VII of FIG. 6.

As shown in FIGS. 4, 6, and 7, a platelike block 10 is attached to a protrusion from the small-diameter portion Tb of the dragging shaft T.

A clamp hole 10*a* is formed through a central portion of the block 10 in order to receive a protrusion from the small-diameter portion Tb of the dragging shaft T. A slit 10*b* is formed in the block 10 in such a manner as to extend in a diametral direction of the clamp hole 10*a* from one end of the block 10 to and beyond the clamp hole 10*a*.

A hole 10*c* is formed through an end portion of the block 10 in which the slit 10*b* is formed, such that the hole 10*c* and the slit 10*b* intersect perpendicularly to each other and such that the hole 10*c* extends off and perpendicularly to the clamp hole 10*a*. The hole 10*c* is composed of a bolt hole and a threaded hole, which extend in opposite directions with respect to the slit 10*b*.

A bolt 11 is screwed into the hole 10*c*.

A circular hole 10*d* is formed through the other end portion of the block 10 in which the slit 10*b* is not formed, in parallel with the clamp hole 10*a*. A hole 10*e* is also formed through the other end portion of the block 10 in such a manner as to intersect the circular hole 10*d* perpendicularly, and in parallel with the hole 10*c*. The hole 10*e* has such an elliptic cross section that a diameter as measured toward the hole 10*c* is greater than that as measured in the axial direction of the circular hole 10*d*. A nut 12 is fitted into the circular hole 10*d* rotatably and such that a threaded hole of the nut 12 is directed perpendicularly to the centerline of the circular hole 10*d*.

A bracket 13 is attached to the outer side face of the bearer 5 and in the vicinity of the circumference of the bearer 5, and projects in parallel with the shaft member 3. The bracket 13 has a root portion 13*a* having a circular cross section. The root portion 13*a* is rotatably fitted into a hole 13*c* which is formed in the outer side face of the bearer 5 and in the vicinity of the circumference of the bearer 5.

A bolt hole 13*b* is formed through the bracket 13 in parallel with the outer side face of the bearer 5. A bolt 14 is inserted into the bolt hole 13*b* with an appropriate gap maintained therebetween and into the hole 10*e* formed in the block 10, and is screwed into the nut 12. An appropriate gap is maintained between the bolt 14 and the major-diameter wall of the hole 10*e*. A snap ring 15 is attached to the bolt 14 so as to hold the bracket 13 in cooperation with a bolt head, thereby preventing an axial movement of the bolt 14 with respect to the bracket 13.

As shown in FIGS. 1 and 9, a block 16 serves as the deflection suppression means C. The block 16 is fitted into a depression formed in a central portion of the cylinder body 1 and faces the blanket insertion groove 1*b* and the dragging-shaft accommodation bore 1*a*.

The block 16 has an outer curved surface which forms a portion of the outer circumferential surface of the cylinder body 1; a side wall 16*a* which forms a portion of the side wall 1*e* of the blanket insertion groove 1*b*; and an inner curved surface 16*b* which is concentric with the dragging-shaft accommodation bore 1*a*.

As described previously, the dragging shaft T is a round rod having a diameter which is appropriately smaller than that of the dragging-shaft accommodation bore 1*a*. An appropriate gap is formed between the dragging shaft T and the wall of the dragging-shaft accommodation bore 1*a*. The inner curved surface 16*b* of the block 16 has a diameter smaller than that of the dragging-shaft accommodation bore 1*a* and faces the circumferential surface of the dragging shaft T with a small gap formed therebetween so that the block 16 can rotatably support the dragging shaft T while restricting deflection of the dragging shaft T to an amount corresponding to the small gap.

The blanket W as shown in FIG. 8 is mounted onto the blanket cylinder P of a printing unit by means of the blanket-mounting mechanism S. As shown in FIG. 8, the band sheets 23 and 24 serving as reinforcing members are attached to the parallel, opposite end portions 21 and 22, respectively, across the width of the blanket W. The band sheet 23 is attached to one end portion 21 of the blanket W and on the side of the blanket W which comes into contact with blanket cylinder P when the blanket W is mounted on the blanket cylinder P. The other band sheet 24 is longitudinally folded in two and is attached to the other end portion 22 of the blanket W such that end portion 22 is sandwiched therebetween.

The blanket W is mounted onto the blanket cylinder P of a printing unit in the following manner.

(1) The bolt 11 of the correction means B is loosened beforehand by means of a tool (not shown) so as to widen the slit 10*b* to thereby release the small-diameter portion Tb of the dragging shaft T so that the dragging shaft T can rotate freely. The bolt 14 is rotated by means of a tool (not shown) so as to rotate the block 10 counterclockwise, to an appropriate angular position, about the small-diameter portion Tb of the dragging shaft T.

(2) The dragging shaft T must be in such an angular position that the blanket-end insertion groove 6 formed therein is aligned with the blanket insertion groove 1*b* formed in the cylinder body 1. If the dragging shaft T is not in such a position, a tool (not shown) is engaged with the shaft end portion 8*a* of the worm 8 of the rotating means A. By use of the tool, the dragging shaft T is rotated thereto via the worm wheel 7.

(3) The end portion 21 of the blanket W is inserted into the blanket insertion groove 1*b* formed in the cylinder body 1 such that the band sheet 23 attached to the blanket end portion 21 faces the side wall 1*c* of the blanket insertion groove 1*b* (see FIG. 9).

Upon starting a printing press, the blanket cylinder P is rotated at low speed and clockwise in FIG. 9. The blanket W begins to be wound onto the circumferential surface of the blanket cylinder P. Upon completion of about one rotation, the blanket cylinder P is caused to stop rotating. The blanket W is wound on the blanket cylinder P.

(4) The other end portion 22 of the blanket W is inserted into the blanket insertion groove 1*b* along the side wall 16*a* of the groove 1*b* until the band sheet 24 of the end portion 22 is fitted into the blanket-end reception groove 6 formed in the dragging shaft T (see FIG. 9).

(5) A tool (not shown) is engaged with the shaft end portion 8*a* of the worm 8 of the rotating means A. By means of the tool, the worm 8 is rotated so as to rotate the dragging shaft T counterclockwise in FIG. 9 via the worm wheel 7. The blanket W is windingly dragged in by means of the dragging shaft T.

(6) As the tension exerted by the blanket W increases as a result of the blanket W being dragged in, the end portion 21 of the blanket W located within the blanket insertion groove 1*b* is pressed further toward the side wall 1*c* by a portion of the blanket W which is being dragged in by means of the dragging shaft T. The end portion 21 is only slightly susceptible to deformation by virtue of the band sheet 23 attached thereto as a reinforcing member and is fixed through a cooperative action effected by the edge 1*d* of the blanket cylinder P and a portion of the blanket W which is dragged into the blanket insertion groove 1*b* (see FIG. 10).

Thus, the end portion of 21 of the blanket W does not come off the blanket insertion groove 1*b*.

(7) As the dragging shaft T is rotated further counterclockwise in FIG. 10 to further drag in the blanket W, the tension exerted by the blanket W increases further, causing a deflection of an axially central portion of the dragging shaft T which is directed toward upper right in FIG. 10. However, the deflected portion of the dragging shaft T comes into contact with the inner curved surface 16*b* of the block 16 and disposed in the direction of deflection of the dragging shaft T, thereby preventing a further deflection of the dragging shaft T and thus maintaining constant the tension exerted by the blanket W mounted on the blanket cylinder P.

(8) Preferably, the dragging shaft T and the block 16, which come into contact with each other, are formed of a material which wears relatively only slightly, and their contact surfaces are treated so as to prevent an increase in frictional force.

The axial width of the block 16 is appropriately narrow, and the contact area between the inner curved surface 16*b* and the dragging shaft T is appropriately small. Accordingly, even when the circumferential surface of the dragging shaft T comes into contact with the inner curved surface 16*b* of the block 16, the resulting frictional force does not prevent rotation of the dragging shaft T, and wear is less likely to result.

(9) The blanket W is wound onto the blanket cylinder P by use of the rotating means A. In this connection, due to friction between the small-diameter portion Tb of the dragging shaft T and the circular hole 1*f* formed in the bearer 5, the angular displacement of the small-diameter portion Ta of the dragging shaft T which is directly rotated by the rotating means A is greater than that of the small-diameter portion Tb of the dragging shaft T which is rotated as a follower, causing a torsion of the dragging shaft T. As a result, the tension exerted by the blanket W becomes nonuniform.

The nonuniform tension exerted by the blanket W is compensated in the following manner. The bolt 11 of the correction means B shown in FIGS. 4 and 6 is tightened by means of a tool (not shown) so as to narrow the slit 10*b* to thereby grip the small-diameter portion Tb of the dragging shaft T by means of the block 10. The bolt 14 is rotated by means of a tool (not shown) so as to move the nut 12 in the axial direction of the bolt 14 such that the block 10 rotates clockwise in FIGS. 4 and 6 about the axis of the small-diameter portion Tb. Notably, rotation of the nut 12 is restrained. Specifically, the block 10 is rotated so as to compensate an insufficient angular displacement of the small-diameter portion Tb with respect to the angular displacement of the small-diameter portion Ta. The small-diameter portion Tb gripped by the block 10 is rotated accordingly, thereby compensating the insufficient angular displacement.

Thus, the torsion of the dragging shaft T is eliminated, thereby compensating the difference in the tension exerted by the blanket W as observed between the small-diameter portion Ta side and the small-diameter portion Tb side.

As a result, the blanket W is mounted on the blanket cylinder P while being subjected to uniform tension.

Obviously, numerous modifications and variations of the present invention are possible in light of the above teachings. It is therefore to be understood that within the scope of the appended claims, the present invention may be practiced otherwise than as specifically described herein.

What is claimed is:

1. A blanket mounting mechanism comprising:

a blanket cylinder having end faces and a dragging-shaft accommodation bore and a blanket insertion groove, the dragging shaft accommodation bore extending axially through the blanket cylinder, and the blanket insertion groove extending axially on an outer circumferential surface of the blanket cylinder and extending radially to said dragging-shaft accommodation bore;

a dragging shaft having a blanket-end reception groove formed on an outer circumferential surface of the dragging shaft, the blanket-end reception groove having a width and depth so as to receive one end of a blanket to be mounted on the blanket cylinder, said dragging shaft being inserted into said dragging-shaft accommodation bore with a gap maintained therebetween, and rotatably-supported opposite end portions of said dragging shaft projecting from the corresponding end faces of the blanket cylinder;

a rotating device disposed at a side of one end face of the blanket cylinder and connected to the corresponding end portion of said dragging shaft; and a correction device disposed at a side of the other end face of the blanket cylinder, said correction device comprising an angular-displacement member attached to the corresponding end portion of said dragging shaft in such a manner as to be able to grip and release the end portion of said dragging shaft, and adjusting means for angularly displacing and positioning said angular-displacement member about said dragging shaft.

2. A blanket-mounting mechanism according to claim 1, wherein one of two side walls that define said blanket insertion groove is substantially in parallel to a plane tangent to said dragging-shaft accommodation bore, and the other side wall extends in a radial direction of the blanket cylinder and toward a center of the dragging-shaft accommodation bore, so that said blanket insertion groove assumes a wedged cross section that tapers down toward the outer circumferential surface of the blanket cylinder.

3. A blanket-mounting mechanism according to claim 2, further comprising deflection suppression means disposed in the blanket cylinder in at least one axial position, said deflection suppression means facing the circumferential surface of said dragging shaft accommodated within said dragging-shaft accommodation bore with a small gap formed therebetween, said deflection suppression means rotatably supporting said dragging shaft while restricting deflection of the dragging shaft to an amount corresponding to the small gap.

4. A blanket-mounting mechanism according to claim 3, wherein said blanket cylinder includes a depression formed therein and said deflection suppression means is a block fitted in the depression formed in the blanket cylinder, and the block has a cylindrically curved inner surface which is concentric with said dragging-shaft accommodation bore, which has a diameter smaller than that of said dragging-shaft accommodation-bore, and which faces the circumferential surface of said dragging shaft with a small gap formed therebetween so that the block can rotatably support said dragging shaft while restricting deflection of the dragging shaft to an amount corresponding to the small gap.

5. A blanket-mounting mechanism according to claim 1, further comprising deflection suppression means disposed in the blanket cylinder in at least one axial position, said deflection suppression means facing the circumferential surface of said dragging shaft accommodated within said dragging-shaft accommodation bore with a small gap formed therebetween, said deflection suppression means rotatably supporting said dragging shaft while restricting deflection of the dragging shaft to an amount corresponding to the small gap.

6. A blanket-mounting mechanism according to claim 5, wherein said blanket cylinder includes a depression formed therein and said deflection suppression means is a block fitted in the depression formed in the blanket cylinder, and the block has a cylindrically curved inner surface which is concentric with said dragging-shaft accommodation bore, which has a diameter smaller than that of said dragging-shaft accommodation bore, and which faces the circumferential surface of said dragging shaft with a small gap formed therebetween so that the block can rotatably support said dragging shaft while restricting deflection of the dragging shaft to an amount corresponding to the small gap.

* * * * *